US012569102B2

(12) United States Patent
Shary et al.

(10) Patent No.: US 12,569,102 B2
(45) Date of Patent: Mar. 10, 2026

(54) FLEXIBLE BRUSH SYSTEM

(71) Applicant: THE MALISH CORPORATION, Mentor, OH (US)

(72) Inventors: Kenneth L. Shary, Ft. Myers, FL (US); Jerry D. Schemm, Mentor, OH (US)

(73) Assignee: THE MALISH CORPORATION, Mentor, OH (US)

( * ) Notice: Subject to any disclaimer, the term of this patent is extended or adjusted under 35 U.S.C. 154(b) by 374 days.

(21) Appl. No.: 18/249,171

(22) PCT Filed: Oct. 13, 2021

(86) PCT No.: PCT/US2021/054742
§ 371 (c)(1),
(2) Date: Apr. 14, 2023

(87) PCT Pub. No.: WO2022/081680
PCT Pub. Date: Apr. 21, 2022

(65) Prior Publication Data

US 2023/0380649 A1 Nov. 30, 2023

Related U.S. Application Data

(60) Provisional application No. 63/113,391, filed on Nov. 13, 2020, provisional application No. 63/092,163, filed on Oct. 15, 2020.

(51) Int. Cl.
*A47L 11/40* (2006.01)
*A46B 5/00* (2006.01)
(Continued)

(52) U.S. Cl.
CPC ..... *A47L 11/4038* (2013.01); *A46B 5/0075* (2013.01); *A46B 5/0095* (2013.01);
(Continued)

(58) Field of Classification Search
CPC ..... A47L 11/40; A47L 11/283; A47L 11/30; A46B 13/02
See application file for complete search history.

(56) References Cited

U.S. PATENT DOCUMENTS 1,653,108 A * 12/1927 Koenig ..... B24B 23/02 464/169
3,823,516 A 7/1974 Christian
(Continued)

FOREIGN PATENT DOCUMENTS

GB 2444773 A 6/2008

OTHER PUBLICATIONS

Extended European Search Report issued Oct. 15, 2024, in European Patent Application No. 21880976.2, 10 pages.
(Continued)

*Primary Examiner* — Michael D Jennings
(74) *Attorney, Agent, or Firm* — Vorys, Sater, Seymour and Pease LLP; Rex W. Miller, II

(57) ABSTRACT

A brush system utilizable with a floor-cleaning machine includes brush head, a coupler, and a riser, wherein the coupler is a flexible coupler for adjusting the position of the riser relative to the brush head. The brush head essentially comprises a bristled pad that may be peeled off a floor machine pad driver.

15 Claims, 11 Drawing Sheets

(51) Int. Cl.
*A46B 9/02* (2006.01)
*A46B 13/00* (2006.01)
*A46B 13/02* (2006.01)

(52) U.S. Cl.
CPC ..... *A46B 9/02* (2013.01); *A46B 13/008* (2013.01); *A46B 13/02* (2013.01); *A46B 2200/3033* (2013.01)

(56) References Cited

U.S. PATENT DOCUMENTS 3,908,220 A * 9/1975 Adamson ..... A47L 11/4038 451/353
4,137,601 A 2/1979 Eschenbach
4,271,557 A * 6/1981 Caron ..... A47L 11/4058 15/49.1
4,888,843 A * 12/1989 Smith ..... A47L 11/4069 411/510
5,692,808 A * 12/1997 Heuvelman ..... A46D 1/055 15/1
5,706,549 A * 1/1998 Legatt ..... A47L 11/4044 15/385
5,806,132 A * 9/1998 Kelley ..... A47L 11/4069 451/353
7,530,135 B2 * 5/2009 Benedict ..... A46B 11/08 15/29
7,587,779 B2 * 9/2009 Walz ..... A47L 11/4038 15/49.1
8,453,293 B1 * 6/2013 Monson ..... A47L 11/4038 15/322
2004/0255420 A1 12/2004 Shary et al.
2013/0344785 A1 * 12/2013 Weder ..... B24B 7/186 451/529
2014/0007368 A1 * 1/2014 Larson ..... A47L 11/162 15/256.5
2019/0002948 A1 1/2019 Ferapontova

OTHER PUBLICATIONS

International Search Report and Written Opinion issued Jan. 25, 2022 for PCT/US21/54742 filed Oct. 13, 2021, 10 pages.

* cited by examiner

FLEXIBLE BRUSH SYSTEM

CROSS-REFERENCE TO RELATED APPLICATIONS

The present application is a national stage application of pending International Patent Application No. PCT/US2021/054742, filed Oct. 13, 2021, which claims priority to and benefit from Provisional Patent Application No. 63/092,163 filed 15 Oct. 2020 and Provisional Patent Application No. 63/113,391 filed 13 Nov. 2020, all of which are hereby incorporated by reference in their entirety.

BACKGROUND

The present subject matter relates to floor maintenance machines and, specifically, to the construction of a new and novel brush head device adapted for detachable connection to a floor maintenance machine of the type particularly suited for use in residential, commercial, institutional and industrial floor maintenance applications such as cleaning, buffing, burnishing and polishing. In such machines, a series of cleaning pads are typically utilized having various abrasive characteristics that are rotated upon actuation of the machine to perform various maintenance operations including buffing, burnishing, spray-buffing, polishing, and the like. These cleaning pads are detachably mounted on the pad holder via a series of polymeric (plastic) hook and loop bristles. These pad-type cleaning systems have many important draw backs. For example, these cleaning pads lose their abrasive characteristics and tend to wear out after multiple work applications, thereby rendering them unsuitable for continued use in their intended application. Also, these cleaning pads are not proficient in cleaning uneven floors with deep recesses, such as deep grouts or contoured tile. Further, these cleaning pads are not easy to use as they are oftentimes difficult to center and maintain in proper functional position during relatively high-speed operations on irregular or non-smooth surfaces. Moreover, these cleaning pads are difficult to clean and maintain, and are relatively time consuming and expensive to replace.

Therefore, there is a need for a brush head that will not only allow for the easy maintenance of a work surface or floor, especially one with deep grouts or contours, but for a device that is easy to use, reliable in performance and relatively inexpensive to produce and maintain.

SUMMARY

Embodiments described herein are directed towards a brush system for a floor machine. In some embodiments the brush system comprises a brush head having, a flexible coupler attached to the central opening, and a riser attached to the flexible coupler, wherein the flexible coupler is expandable to vary position of the riser relative to the brush head. In other embodiments, the brush head of the brush system comprises a pad having a bristle surface and a floor machine mounting surface opposite the bristle surface; a plurality of tuft sites protruding from the bristle surface and defining a weight reducing void between neighboring tuft sites; and a tuft of bristles arranged in at least one of the tuft sites. In other embodiments, at least one of the tufts of bristles is flared. In other embodiments, the coupler is adjustable between a fully collapsed position and a fully extended position, wherein the brush head is relatively further from the riser when in the fully extended position as compared to the fully collapsed position. In other embodiments, the coupler is adjustable into one or more intermediate positions between the fully collapsed position and the fully extended position. In other embodiments, the brush head of the brush system comprises includes a central opening and the coupler is connected to the brush head about the central opening. In other embodiments, the brush head of the brush system comprises includes a lip extending around the central opening, the coupler is attached to an upper surface of the lip. In other embodiments, the riser comprises a top surface and a plurality of tabs on the top surface. In other embodiments, the brush head is circular in shape. In other embodiments, at least one cut-out is provided in the pad and extends between the bristle surface and the mounting surface. In other embodiments, the cut-out is a centrally located cut-out that is coaxial with the pad. In other embodiments, the cut-out is an intermediate cut-out provided at an intermediate region of the pad between a radial center and periphery of the pad. In other embodiments, the intermediate cut-out includes a plurality of intermediate cut-out symmetrically provided about the pad. In other embodiments, at least one zone without tuft sites is provided on the bristle surface. In other embodiments, the plurality of tuft sites are arranged in concentrically extending rows corresponding with a periphery of the pad.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to floor cleaning equipment and, more particularly, to brush system having a flexible brush head that is utilizable on a wide variety of pad drivers.

Embodiments herein are directed towards a coupling system for a brush head. The coupling system permits the brush head to be utilizable on a variety of different types of floor cleaning machines. Embodiments herein are also directed towards a flexible brush head utilizable with the coupling system. The flexible brush head may be peeled off of the floor machine and may be lighter weight than traditional brush heads.

Figure 1:
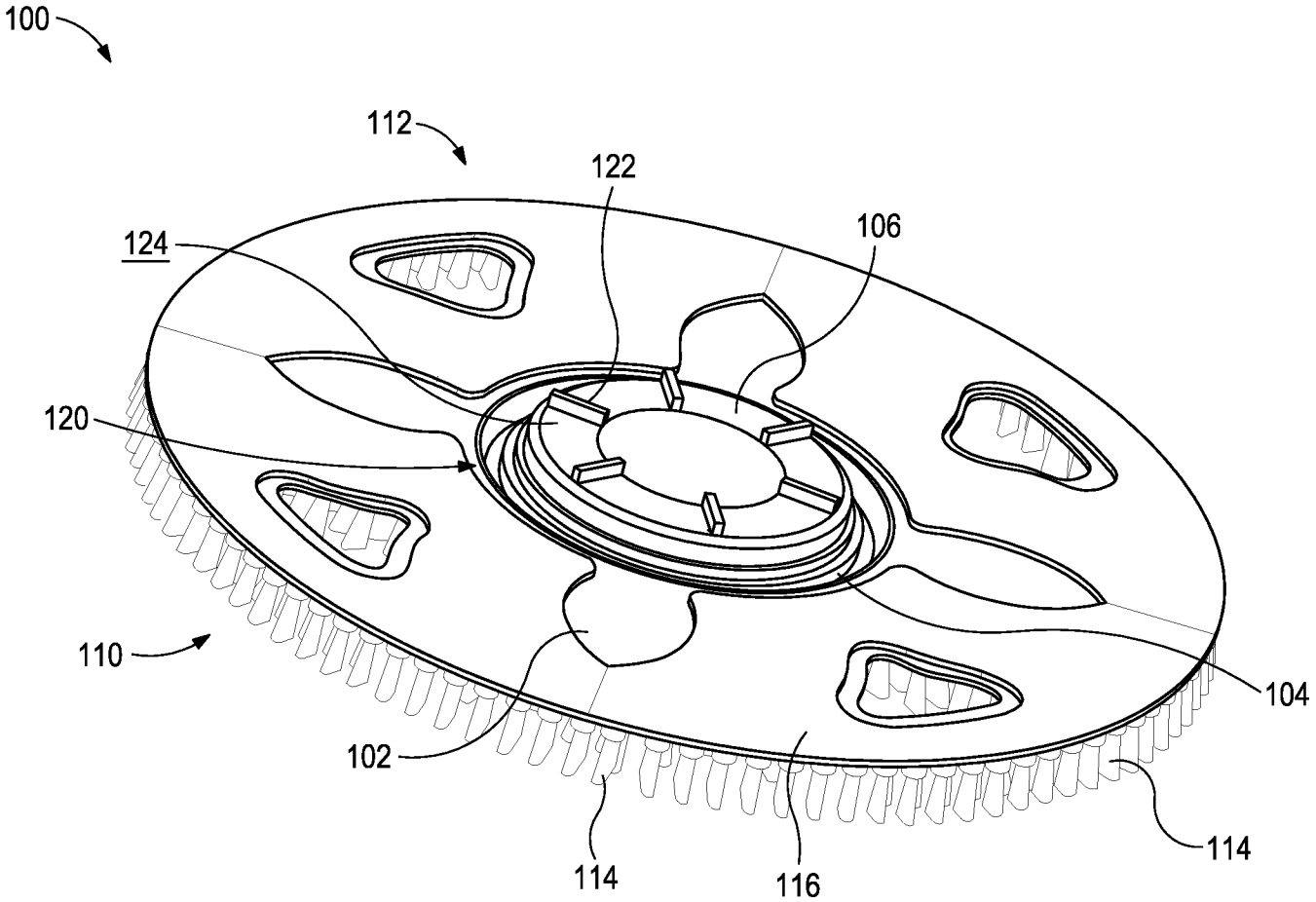
FIG. 1 is an isometric view of scrubbing system, according to one or more embodiments of the present disclosure.
Figure 2:
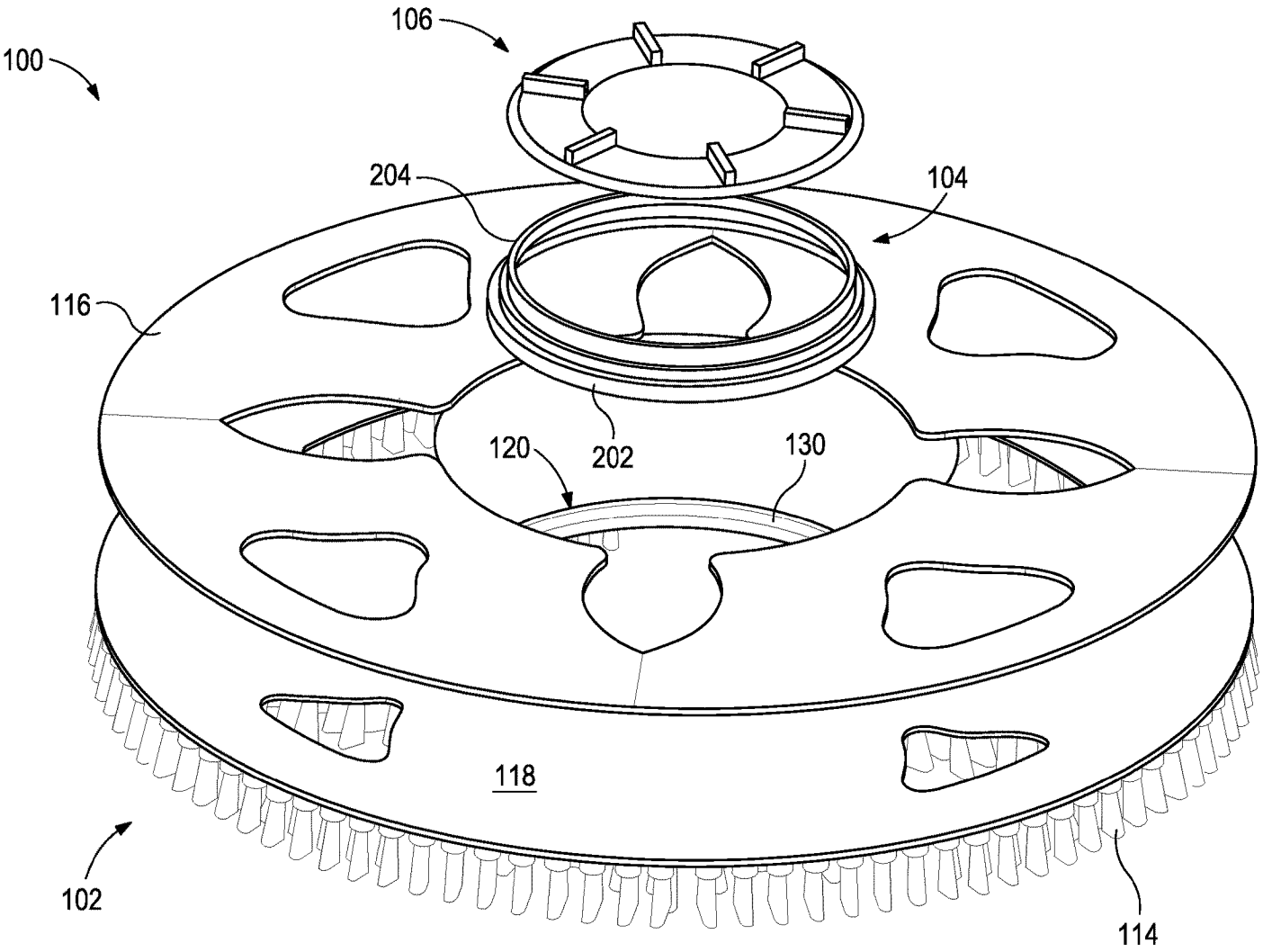
FIG. 2 is an exploded view of the scrubbing system of FIG. 1.

FIG. 1 illustrates a scrubbing system 100 according to one or more embodiments of the present disclosure. FIG. 2 illustrates an exploded view of the scrubbing system 100 of FIG. 2. The scrubbing system 100 may be utilized on various types of floor cleaning machines (not illustrated), such as a rotary machine that has a rotating interface, which thereby causes rotation of the scrubbing system 100, or an oscillatory floor machine which causes oscillation of the system 100, or combinations of the same, etc.

In the illustrated example, the scrubbing system 100 includes a brush head 102, a coupler 104, and a riser 106. The brush head 102 includes a lower side or bristle side 110 and an opposite upper side 112 which faces the floor machine when attached thereto. The bristle side 110 includes a plurality of bristles or tufts of bristles 114 configured to engage a floor. The system 100 may also a plurality of Velcro or adhesive strips 116 provided on an upper side 118 of the brush head 102 to facilitate attachment to the floor machine in some cases.

Here, the coupler 104 is provided in a central cavity 120 provided in the brush head 102, and the coupler 104 extends upward from the upper side 112 of the brush head 100. Also, the riser 106 is provided on an upper end of the coupler 104. Thus, the coupler 104 is provided between and interconnects the brush head 102 and the riser 106. In some examples, the coupler 104 is integrally attached to the brush head 102 and the riser is integrally attached to the coupler 104, that that the brush head 102, the coupler 104, and the riser 106 are integral with each other defining a unitary component.

Also in the illustrated example, a plurality of tabs or fins 122 on an upper surface 124 of the riser 106. The tabs 122 are vertically extending members that may engage within a pad driver (e.g., spikes) to thereby transmit torque and to inhibit rotational slippage between the brush head 102 and the rotatable pad driver (not illustrated). Thus, the riser 106 facilitates transmission of torque from the pad driver of the floor machine (not shown) to the brush system 100 and inhibits relative rotation there-between. In this manner, the riser 106 and the coupler 104 also facilitate attachment of the brush head 102 to the pad driver of the floor machine (i.e., the riser 106 and the coupler 104 enhance gripping strength of the brush head 102 to the machine's pad driver), and thereby enhance attachment that may otherwise be provided solely by the Velcro 118. For example, the brush head 102 would only be attached to the pad driver of the machine without the riser 106 and the coupler 104, in which case the brush head 102 could come loose therefrom and/or experience undesirable relative rotation (slippage) relative to the machine's pad driver, but the riser 106 and the coupler 104 help ensure that the Velcro attachment remains secure without any slippage. In addition, the riser 106 and the coupler 104 provide a means for properly positioning and centering the brush head 102 on the pad driver of the machine. Further, the riser 106 and the coupler 104 may include a central opening that is suitably dimensioned to receive to portion or shaft of a machine (or centering ring), such that the brush system 100 may be clamped onto the machine. While not illustrated in this example, one or more holes may be provided in the top surface of the riser 106, for example, between the tabs 122, for engagement with spikes on the pad driver and/or lock plate.

The coupler 104 may be expandable, such it may be provided in a fully contracted position and then expanded into one or more expanded positions relative to the fully contracted position. FIG. 1 illustrates the coupler 104 in an example extended position. In some examples, the coupler 104 may be a flexible coupler, for example, made from a flexible or elastomeric material. The coupler 104 may be provided of suitable material and may be provided with sufficient thickness to be collapsible while also withstanding rotational torque without tearing/ripping. For example, the coupler 104 may be compressed into a fully retracted position, and then expanded into a fully expanded position, with the coupler 104 capable of remaining in the fully retracted and extended positions without external forces helping maintain those positions and with the coupler 104 capable of being in any intermediate position there-between if acted upon (or supported) by an external force exerted by attachment of the system 100 to the floor machine. For example, the coupler 104 may be formed such that it is capable of resting in the retracted position but then "snap" outward therefrom into one or more extended positions due to the elastomeric material and wall configuration (with ridges in its walls, stepped walls, etc.) of the coupler 104. For example, the coupler 104 may be designed to snap into one or more intermediate positions between the extended and retracted positions. Various materials may be utilized to form the coupler 104, such as thermoplastic rubber.

In this manner, the coupler 104 may be expanded or contracted to adjust the orientation of the upper surface 124 of the riser 106 relative to the upper surface 118 of the brush head 102. For example, the coupler 104 may be compressed into a position where the upper surface 124 of the riser is planar with the upper surface 118 of the brush head 102 (or compressed into a position where the upper surface 124 of the riser is offset below the upper surface 118 of the brush head 102). Also, the coupler 104 may be expanded/extended into a position where the upper surface 124 of the riser is offset above the upper surface 118 of the brush head 102, as exemplified in FIG. 1.

FIGS. 1-2 illustrate an example where the tufts of bristles 114 are pre-molded tufts of bristles with a flare. Such flare may be obtained by using holes in the bad which secure the bristle tufts, and providing a flare in the outer diameter of the hole (e.g., 10 degrees on the outer wall) such that the bristles flare out toward the outer diameter. Thus, rather than the tufts of bristles defining a generally cylindrical shape, flared tufts of bristles may define a triangular shape or some other geometry shape such that their distal ends engaging the floor are of larger area than their proximal end at which they are attached to the housing of the brush head 102. As mentioned, the tuft holes may be molded with a specific angle (e.g., of 10 degrees) on the outer wall (OD) of each hole which causes the bristles to flare out toward the out wall. This enables the brush to be made more efficiently and on a simpler brush making machine. However, one or more of the tufts can be inserted perpendicular to the backing. The tufts are anchored to the backing by standard staple wire or standard anchor wire on brush making machinery that is common to the brush making industry. The tufts could be fused as well.

FIGS. 1-2 illustrate an example where attachment strips 116 are provided in four quarter sections, and which encircles the entire upper surface 118 of the brush head 102. However, the attachment strips may be provided as a single strip that may or may not encircle the entire upper surface 118 of the brush head 102, or may comprise more or less strips that may or may not encircle the entire upper surface 118 of the brush head 102. In some examples, the attachment strips 116 have an adhesive lower side for attachment to the upper surface 118 of the brush head 102 and a Velcro upper side for engagement with a pad driver of a machine (not illustrated).

As shown in FIG. 2, the cavity 120 is defined by a downward extending sidewall 130 of the brush head 102. The cavity 120 is sized to retain the coupler 104 therein when the coupler 104 is fully collapsed. The sidewall 130 may extend downward from the lower side surface of the brush head 102 at various orientations, for example, the sidewall 130 may extend perpendicular towards the bottom side 110, or the sidewall 130 may be oriented at an angle relative to the surface of the brush head 102 such that the cavity 120 is frusto-conical in shape. In the illustrated example, the cavity 120 is frusto-conically shaped with a larger diameter at a top side corresponding with top surface 118 and a smaller lower dimeter corresponding with the bottom side 110 of the brush head 102.

FIG. 2 also illustrates an exemplary version of the coupler 104, according to one or more examples. Here, the coupler 104 includes a base portion 202 which is connectable to a lower surface within the cavity 120 of the brush head 102. Also, the coupler 104 includes an upper portion 204 connected to (an upper end of) the base portion 202. The base portion 202 has diameter that varies or decreases from its lower end to its upper end at which it is connected to the upper portion 204, such that the upper end of the base 202 and the upper portion 204 may be depressed within/inside the base portion 202, thereby decreasing the overall height of the coupler 104, and it is this functionality that allows the coupler 104 to extend or retract the riser 106 relative to the brush head 102. For example, the base portion 102 may be provided with ridges/steps allowing a gradual decrease of its diameter towards the upper portion 204, and which would allow an upper end of the base portion 202 (and the upper portion 204) to telescope downward within the base portion 202.

Figure 3:
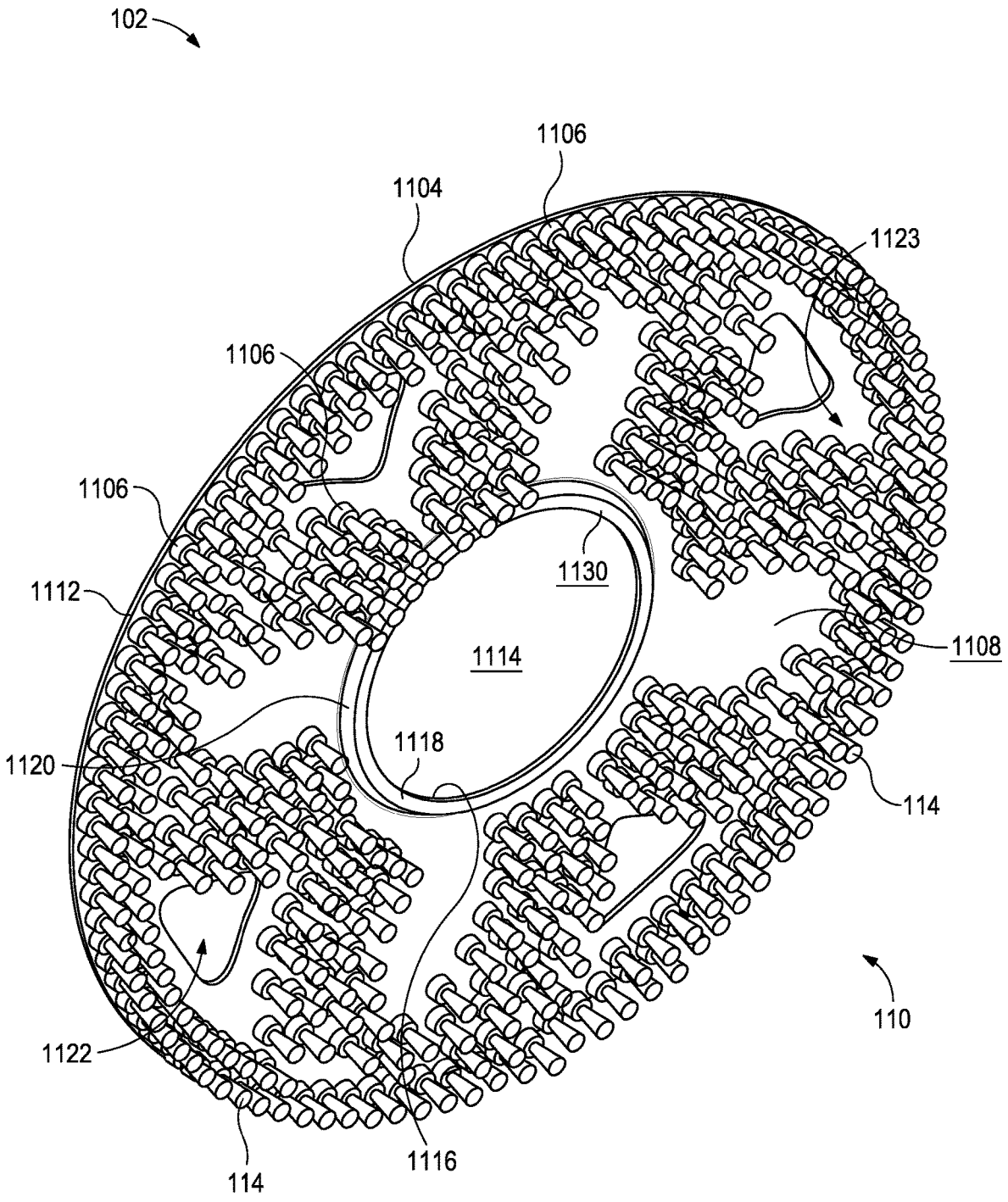
FIG. 3 is an isometric bottom view of an example flexible floor brush utilizable with the scrubbing system of FIG. 1.

FIG. 3 illustrates the brush head 102 utilizable with the system 100 of FIGS. 1-2, according to one or more embodiments of the present disclosure. In particular, FIG. 3 illustrates the bristle (or floor engagement) side 110 of the brush head 102. As illustrated, the brush head 102 includes a brush pad or block or backing 1104. In the illustrated example, the brush pad 1104 is circular in shape and designed for a rotary floor machine, however, in other examples, the pad 1104 may have different shapes (e.g., square/rectangular, trapezoidal, etc.). The brush pad 1104 may be made of various materials, such as for example, a foamed polypropylene. Other materials may be utilized, however, such as thermoplastic polymers such as acrylonitrile butadiene styrene (ABS) or nylon. It should be appreciated that pad 1104 may be constructed from other materials such as ceramics, metals, and/or composites. The brush head 102 is lightweight and will weigh less than 4 pounds (0.5 to 1.5 kg depending on the size and bristle material). By using a pad or backing as described herein the brush head 102 essentially comprises a bristled pad that may be peeled off equipment.

The brush head 102 includes a plurality of tuft sites 1106 provided on a lower surface 1108 of the pad 1104 and configured to receive the bristles or tufts of bristles 114 (i.e., bristle tufts 114). The lower surface 1108 is provided opposite the upper surface 118 (see FIGS. 1-2). The tuft sites 1106 are structures (or protrusions) that protrude (or extend) from the surface 1108 and thereby define recessed areas (i.e., weight reducing voids or recesses) in between the tuft sites 1106, to thereby reduce weight of the brush head 102 and provide it with a degree of flexibility, as compared to a solid block with recessed tuft sites formed therein. In the illustrated example, the recessed areas between the tuft sites 1106 are interconnected with each other such that the plurality of weight reducing recesses between the tuft sites 1106 define a continuous recessed area (or continuous void). In some examples, ribs or walls may be provided on the surface 1108 to interconnect at least a neighboring pair of the tuft sites 1106 (or at least some of the neighboring tuft sites 1106). In this manner, the brush head 102 is lightweight and flexible, and may be peeled off from the floor machine.

One or more weight reducing cutouts may be provided in the pad 1104 to further decease weight, enhance flexibility, and/or to accommodate a mounting means utilizable to connect the brush head 102 to a floor machine. In the illustrated example, the central cavity 120 defines a central cutout 1114 extending through the pad 1104, and the central cut-out 1114 is provided at an interior and central portion of the pad 1104. A lip 1116 may be provided at an outer edge of the cutout 1114 and provides support for the coupler 104 and riser 106 described above. Here, the central cutout 1114 is in alignment with the periphery 1112 of the pad 1104 and a center point of the pad 1104, such that the cutout 1114 defines a geometry that is coaxial with the geometry of the pad 1104. The lip 1116 includes a bottom wall 1118 and an intermediate sidewall portion 1120 interconnecting the bottom wall 1118 of the lip 1116 to the pad 1104. The space constrained between a plane defined by the upper surface 118 of the brush head 102 and the intermediate portion 1120 and the bottom surface 1118 of the lip 1116 defines the central cavity 120, as evaluated from the top side 112 of the brush head 102, as illustrated in FIG. 2, and it is within this space that the coupler 104 and the riser 106 may be positioned. In particular, the base 202 of the coupler 104 may be attached to the bottom wall 1118 of the lip 1116.

Also, the intermediate wall 1120 of the lip 1116 extends (protrudes) from the surface 1108 in a direction generally corresponding with the direction at which the sites 1106 extend from the surface 1108, such that the bottom wall 1118 of the lip 1116 is off-set downward from the surface 1108. In this manner, the intermediate wall portion 1120 constrains the continuous recessed area (or continuous void) defined between the recessed areas between the tuft sites 1106 in a lateral direction measurable along the planar surface 1108 of the pad 1104, such that the continuous recessed area extends outward from the central cut-out 1114 and the lip 1116 towards the periphery 1112 of the pad 1106, to surround the tuft sites 1106. In some examples, an outer lip may be provided at the periphery 1112 such that the continuous recessed area is constrained at the periphery 1112 and extends inward therefrom towards the cut-out 1114 (i.e., such that the continuous recessed area is laterally constrained between such peripheral lip and the intermediate wall portion 1120 of the lip 1116).

A bottom surface 1130 of the bottom wall 1118 may be off-set from the surface 1108 at a distance at which the tuft sites 1106 extend from the surface 1108, such that a bottom surface of the tuft sites 1106 is co-planar with the bottom surface 1118 of the lip 1116; however, the bottom surface 1118 of the lip 1116 may extend a distance that is less than or greater than the distance at which the tuft sites 1106 extend, such that the bottom surface of the lip 1116 lies in a different plane than one or more of the tuft sites 1106 bottom surfaces. The intermediate wall 1120 may be oriented at various angles relative to the bottom surface 1108 and, in the illustrated example, the intermediate portion 1120 is oriented at an obtuse angle relative to the surface 1108 of the pad 1104; however, the wall 1120 may be oriented at other angles, such as a right angle, an acute angle, and/or it may be contoured such that it forms various angles with the surface 1108 about its circumference. Thus, the continuous recessed area (or continuous void) defined between the recessed areas between the tuft sites 1106 is also constrained (in a direction perpendicular to the planar surface 1108 of the pad 1104) by the surface 1108 of the pad 1104, such that the continuous recessed area extends downward from the surface 1108 of the pad 1104 towards the bottom surface 1118 of the lip 1116 and the bottom surfaces of the tuft sites 1106.

In some examples, a peripheral edge 1112 of the pad 1104 defines an outer lip that an end user may handle, engage and, utilize to peel (or pull) the brush head 102 off of a floor cleaning machine. For example, the pad 1104 may be sized larger than the floor machine's mounting surface, such that the periphery 1112 of the pad 1104 extends beyond or overhangs the periphery/extremity of the floor machine, to thereby define a lip like structure that is accessible by the end-user. In some examples, a tab may be integrally provided on the peripheral edge 1112 of the pad 1104 for the end user to engage and utilize to peel the brush head 102 off of the floor machine.

The bristle tufts 114 may be secured within their respective tuft site 1106 via a variety of means (or combination of means). For example, one or more of the bristle tufts 114 may be mechanically fastened within their corresponding site 1106 (e.g., via a staple, anchor, screw, washer, and/or combinations of the same), and/or one or more of the bristle tufts 114 may be adhered within their corresponding site 1106 (e.g., via an adhesive such as epoxy, etc.). In some examples, one or more of the bristle tufts 114 are fused within their corresponding site 1106 and/or directly to the surface 1108 without a tuft site. In some examples, the bristle tufts 114 are secured to the pad 1104 via a combination of attachment means, for example, via mechanical fasteners, adhesive, and/or fusion. While not illustrated, in some examples, the bristle tufts are provided on a removable plate (or puck) that is attachable and detachable to the surface 1108, for example, via a hook and loop fastener, magnets, locking joints or slots (e.g., dove tail joint, tongue and groove joints, etc.), snaps, etc. In this manner, the end user may easily remove and replace worn and used bristles and/or customize (optimize) the brush head 102 to have a particular type of bristle that is desirable for a certain floor type or end use application.

The individual bristles in each bristle tuft 114 may be made from any number of materials, including but not limited to synthetic, abrasive, and natural fibers, or any other similar material. For example, bristles may comprise polypropylene, nylon, polyester or abrasive filaments like Tynex® fibers. It will be appreciated, however, that any number of other filaments and/or materials may be utilized for the bristles, so long as that material provides a rigid and firm bristle capable of supporting the system (as discussed below). Also, the bristles are abrasive, and may thus have an abrasive grit applied to them such that they may abrade a floor surface. Further, the bristles may have any type of surface finish or be coated with a material, for example, the bristles may be coated with an abrasive coating (e.g., Tynex® coated fibers) or other coating having certain characteristics. Also, the bristles may have various similar or dissimilar shape/geometry or surface finish, such as crimping, perforating, etc., which may allow the bristles to collect and retain moisture, and/or perform other functions that may be desirable in a given application. In some examples, some of the bristle tufts 114 have different characteristics than other sets of the bristle tufts 114 (e.g., a first set of tufts having a different abrasive characteristic than a second set of tufts).

In the illustrated example, each tuft of bristles 114 comprises a plurality of individual bristles. The number of bristles per individual tuft 114 will depend upon the requirements of any particular application and the method by which they are mounted within the tuft site 1106. For example, it may be desirable in a certain application to have bristle tufts of a particular density, geometry, shape, etc. In other examples, relatively thick bristles are utilized such that an individual one of such relatively thick bristles is provided in each tuft site 1106. Regardless of how many bristles are secured within each site 1106, such bristle or tuft 114 may have a shape, such as the flared shape illustrated in FIGS. 1-2.

The brush head 102 may include on or more additional weight reducing and/or flexibility providing features. In the illustrated example, one or more intermediate cut-outs 1122 are provided in the pad 1104. While FIG. 3 illustrates and example incorporating four (4) of the intermediate cut-outs 1122 provided in a symmetrical orientation (e.g., one intermediate cut-outs 1122 in each of the four (4) quadrants of the pad 1104), more or less may be provided and, regardless of their number, they may be provided in various symmetrical and/or asymmetrical arrangements. Here, the intermediate cutouts 1122 are provided at an intermediate region of the pad 1104 that is radially outward of the central cutout 1114 and radially inward of the periphery 1112. Also here, the intermediate cutouts 1122 extend fully through a thickness of the pad 1104, but in other examples, one or more of the cutouts 1122 and/or a portion of one or more of the cutouts 1122 may just be a thinning of the pad's 1104 thickness rather than extending through the entirety of the pad thickness.

In some non-illustrated examples, regions 1123 of the surface 1108 of the pad 1104 surrounding (or bordering) one or more of the intermediate cut-outs 1122 is configured to receive a separate plate (or pad or puck) of bristles. For example, FIG. 3 illustrates an example without tuft sites 1106 at areas on the pad 1104 corresponding with the intermediate cut-outs 1122 and at the bordering regions 1123 of the pad 1104 surface 1108 bordering/surrounding the intermediate cut-outs 1122; however, one or more separate pad (or plate) pieces with tuft sites supporting bristle tufts (i.e., bristle pucks) may be secured at those regions such that an entirety of the pad 1104 surface 1104 has tuft sites 1106 and bristle tufts 114. In such examples, the pad/plates may be shaped to correspond with the shape of the bristleless region on the pad 1104 surface 1108 to which the bristle puck is to be mounted. Also in these examples, the bristle pucks may be mounted to the pad 1104 via various permanent and/or temporary attachment means, such as a hook and loop fasteners, snap fit fasteners, screws and/or washers, adhesives, magnets, etc. For example, the portions of the pad 1104 surface 1108 bordering the intermediate cut-outs 1122 (which are illustrated without tuft sites 1106 in the example embodiment of FIG. 3) may include a hook and loop fastening material, and a mounting surface of a corresponding bristle pucks may have a corresponding hook and loop fastening material attachable thereto.

Figure 4A:
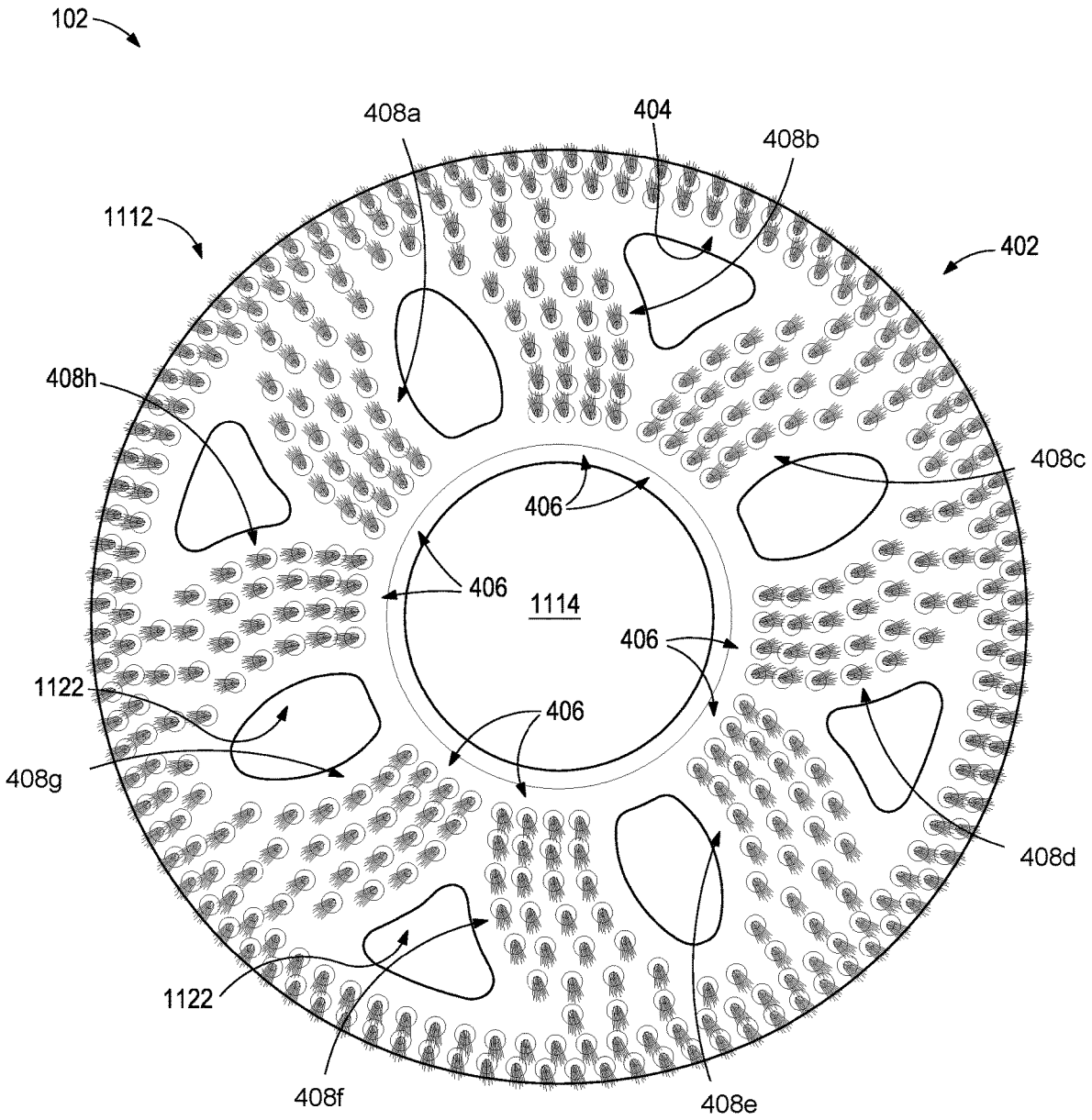
FIGS. 4A-4B are bottom views of the brush head of FIG. 1.
Figure 4B:
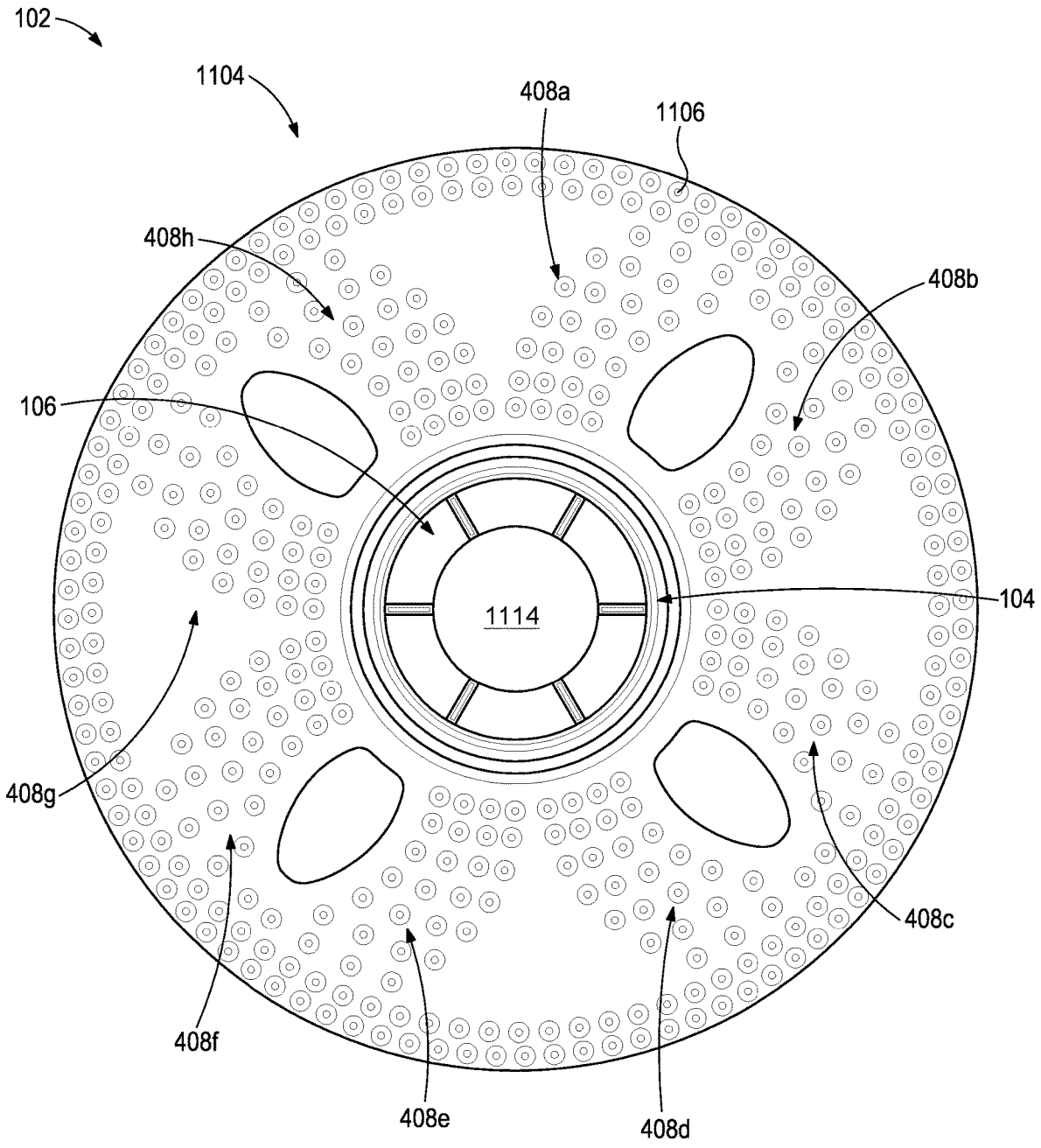

The tuft sites 1106 may be arranged in rows. For example, the tuft sites 1106 may be arranged in radially extending rows, for example, radially extending rows that extend from the periphery 1112 of the pad 1104 towards a radial center (or center point) of the pad 1104. In these examples, the tuft sites 1106 in each of the radially extending rows may be aligned along a radius of the pad 1104 and/or aligned with the other tuft sites 1106 in that particular row. In some examples, one or more of the tuft sites 1106 in a particular radially extending row may be offset or staggered from the other tuft sites 1106 in that particular row. In some examples, the tuft sites 1106 may be arranged in concentrically extending rows, for example, rows that correspond with a geometry of the periphery 1112. For example, the pad 1104 may include an outer concentric row of tuft sites, a next inner concentric row of tuft sites, a next inner concentric row of tuft sites, and so on. In these examples, the tuft sites 1106 in one of the concentric rows of tuft sites may be aligned with the tuft sites of another of the concentric rows of tuft sites (i.e., a neighboring concentric row or a concentric row that is separated by another concentric row), or the tuft-sites in one concentric ring may be off-set from the tuft sites in other concentric rings such that a uniform spacing between tuft sites may be maintained. FIGS. 4A-4B illustrate bottom views of an exemplary brush head 102. In the illustrated example, a pair of rings 404, 404 of tuft sites 1106 are provided proximate the periphery 1112, including an outer most concentric ring 402 of tuft sites 1106 next to the periphery 1112 of the pad 1104 and an next-interior ring 404 of tuft sites 1106 is provided radially inward of the out-most concentric ring. It will be appreciated that one or more additional interior rings of tuft sites may be provided inward of the outer-most. Also in the illustrated example, tuft sites extend outward from the central cutout 1114 towards the periphery 1112. Here, for example, eight (8) sets 406 of tuft sites radially extend from the central cut-out 1114. As shown, each radially extending set of tuft sites 406 includes a curvature such that it does not fully align upon a radius of the circular pad 1104, but instead is curved to extend radially outward from the center with a clock-wise or a counter-clock-wise directed bend as it approaches the periphery 1112. Also, each radially extending set of tuft sites 406 has an opposite curvature compared to the neighboring radially extending set of tuft sites 406, such that the curvature alternates between clockwise, counter-clockwise, etc. In this manner, the brush head 102 may be configured for both clockwise and counter clockwise rotation; however all of the radially extending set of tuft sites 406 may have the same clockwise or counter clockwise curvature, and/or any one or more of the radially extending set of tuft sites 406 may align upon a radius of the circular pad 1104. In particular, the illustrated example includes a first radially extending set of tuft sites 408*a* having a clockwise curvature, a second radially extending set of tuft sites 408*b* having a counter-clockwise curvature, a third radially extending set of tuft sites 408*c* having a clockwise curvature, a fourth radially extending set of tuft sites 408*d* having a counter-clockwise curvature, a fifth radially extending set of tuft sites 408*e* having a clockwise curvature, a sixth radially extending set of tuft sites 408*f* having a counter-clockwise curvature, a seventh radially extending set of tuft sites 408*g* having a clockwise curvature, and an eighth radially extending set of tuft sites 408*h* having a counter-clockwise curvature.

Figure 5:
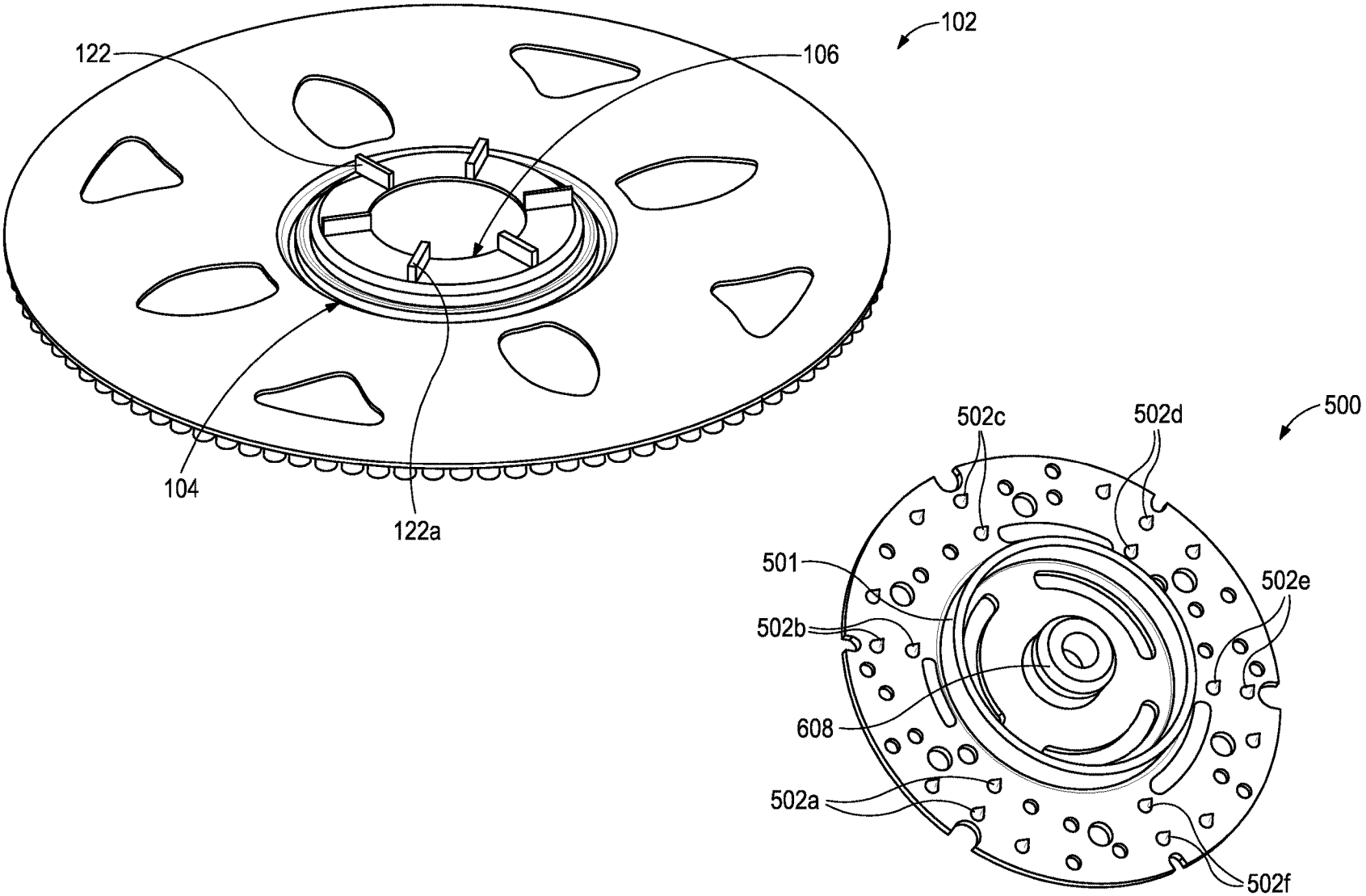
FIG. 5 illustrates an example operation of the coupling system of FIG. 1.
Figure 6A:
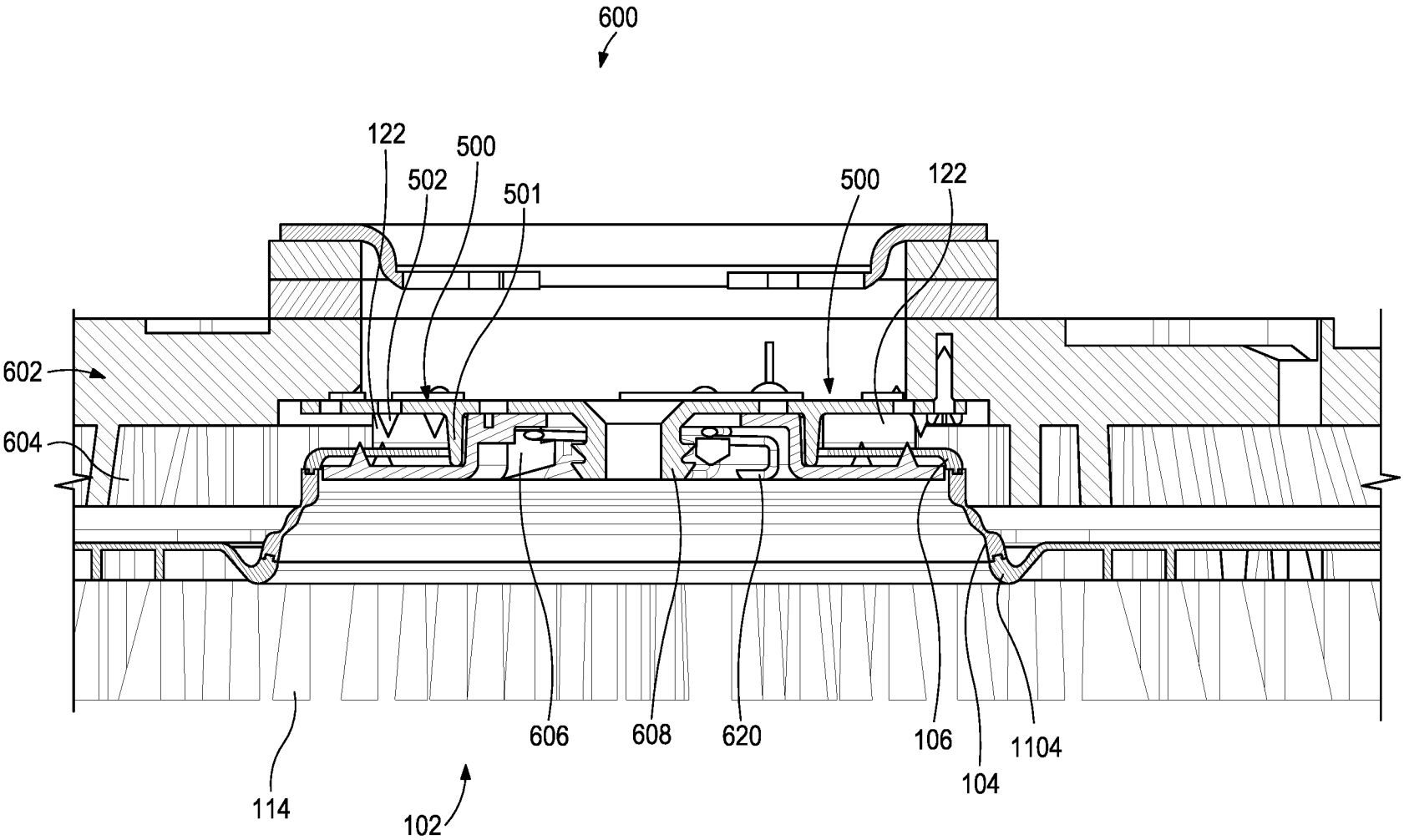
FIGS. 6A-6C another example operation of the coupling system of FIG. 1.
Figure 6B:
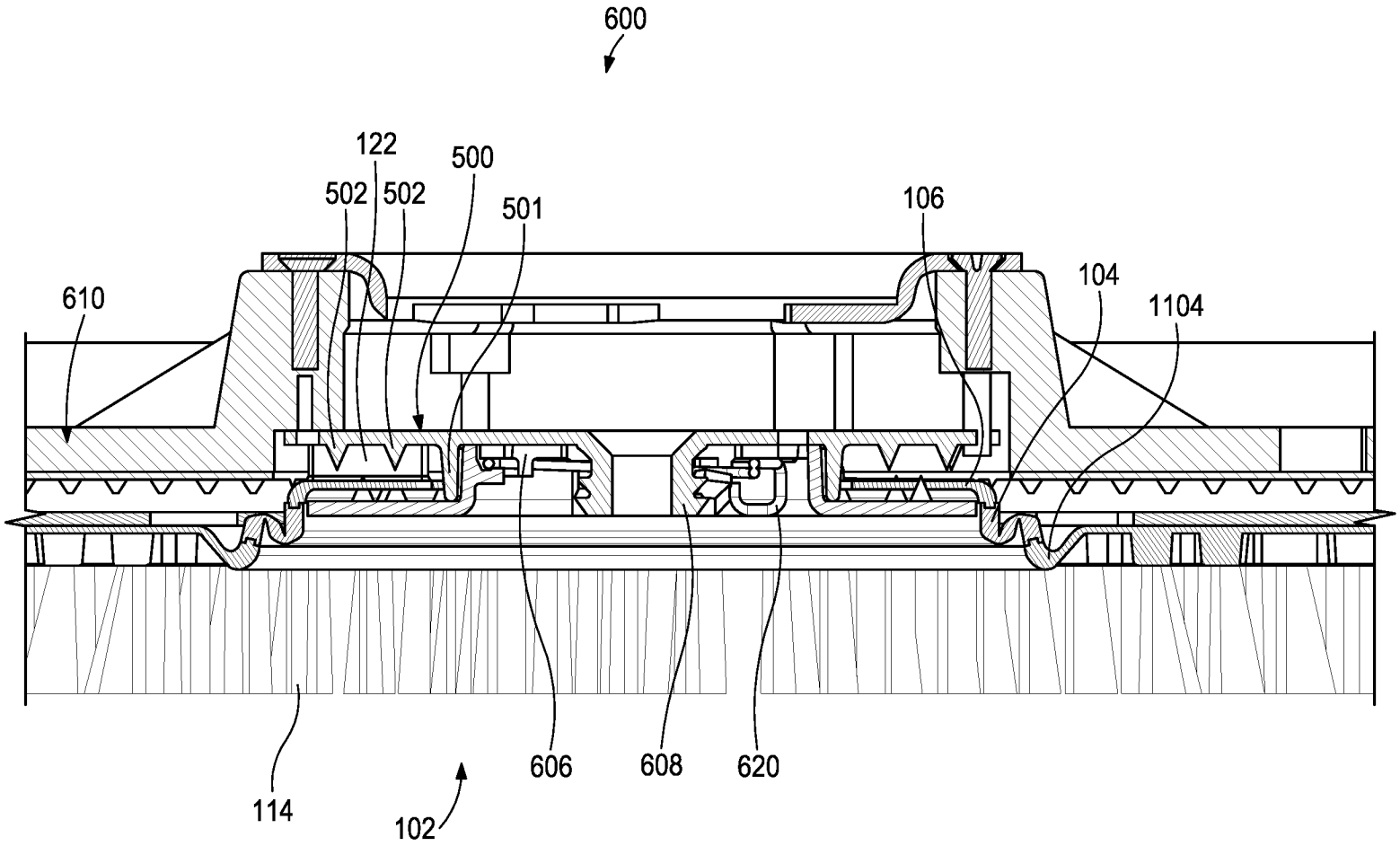

FIG. 5 illustrates example operation of the coupling system described with reference to FIGS. 1-2 on an example centering device 500 of a floor machine, according to one or more examples. The illustrated centering device 500 upon which the present disclosure may operate. Indeed, aspects of the present disclosure may operate on differently configured machines and/or centering devices without departing from the present disclosure. In the illustrated example, the centering device 500 includes a centering ring 501 and six pairs of spikes (i.e., 502*a*, 502*b*, 502*c*, 502*d*, 502*e*, 502*f*. Here, the riser 106 is configured engage the centering device 500. In some examples, as shown in FIGS. 6A-6B, the riser 106 may include corresponding mounting holes 630 for receiving each of the spikes 502. As mentioned below, in addition or instead, the riser 106 may include includes the tabs/ribs 122 such that, during operation, each of the tabs engages one of the pairs of spikes. For example, a first tab 122*a* will engage the first set of spikes 502*a*, and so on, such that the brush system 100 does not slip when installed on the centering device. In particular, the centering device 500 is mounted on the floor machine (not illustrated) and the floor machines drives rotation of the centering device, and it is desirable that there is little to no rotational slippage between the brush head 102 and the centering device 500. Engagement of the tabs 122 and the spike pairs 502 eliminates such slippage and ensures the brush head 102 is rotated with adequate force.

Figure 6C:
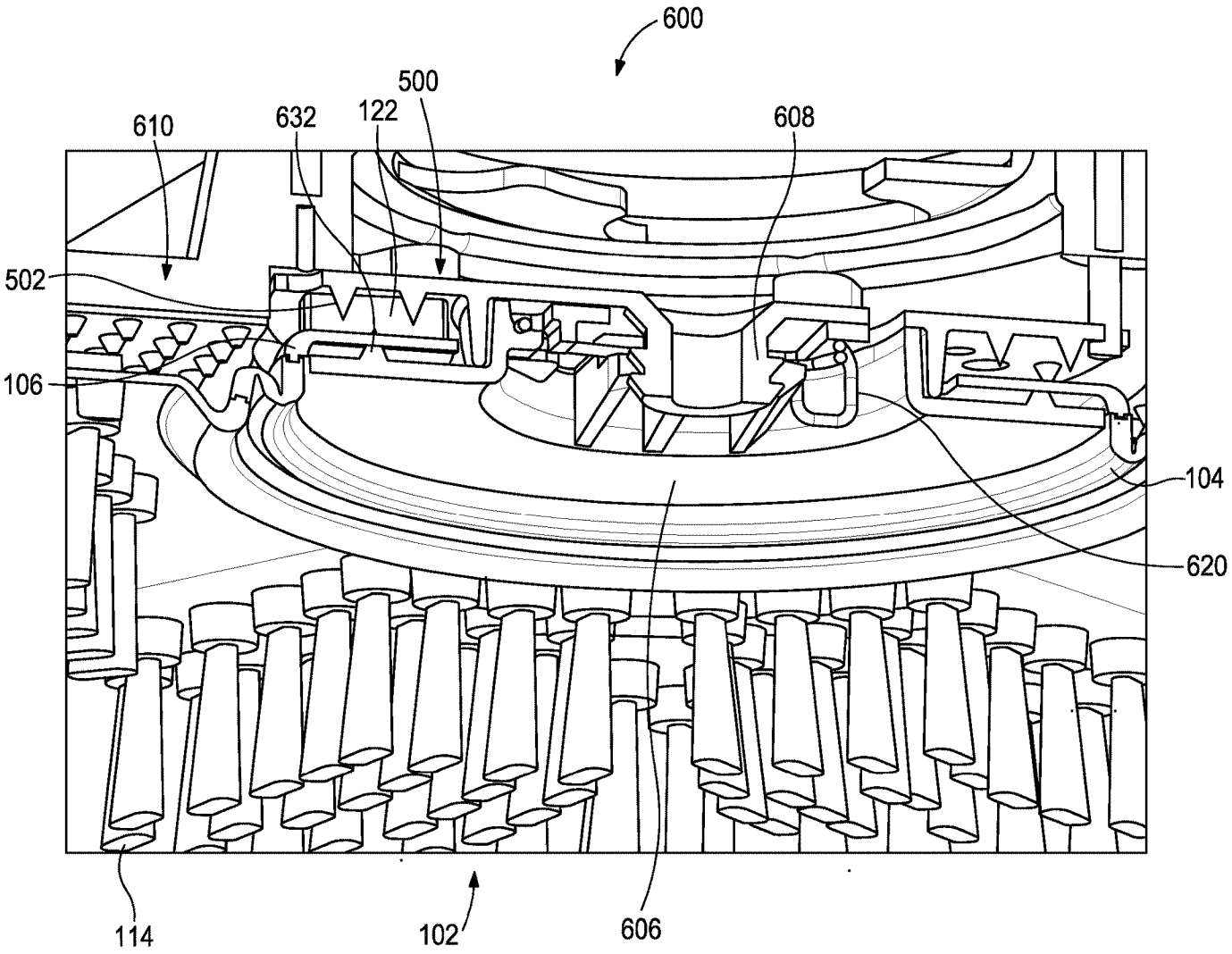

FIGS. 6A-6C illustrate another example operation of the brush system 100 of FIG. 1 on a floor machine 600 utilizing different types of pad drivers. FIG. 6A illustrates the floor machine 600 utilizing a first type of pad 602, whereas FIGS. 6B-6C illustrate the floor machine 600 utilizing a second type of pad 610. With regard to FIG. 6A, the first pad 602 is a tufted pad driver having tufts 604 extending downward from the machines rotary component and which form a surface which abuts the back surface 118 of the brush head 102, and these tufts are configured to mate with the attachment pads 116 of the brush head 102 (e.g., corresponding hook and loop fasteners). However, with this type of set-up, the tufts 604 on which the back surface 118 of the brush head 102 abut defines a mounting surface that is off-set (i.e., below) a surface defined by the centering ring 500, and the attachment pads 116 would be the only means of transmitting torque to the brush head 102 but for the coupling system. Thus, in this example, the coupler 104 may be extended into its extended position such that the riser 106 may abut the surface of the centering device 500 and thereby permit engagement of the riser's tabs 122 with the spikes 502 of the centering device 500. If not for the extendibility of the coupler 104, the riser's tabs 122 would be positioned at a level corresponding to the surface defined by the tufts 604, such that the tabs 122 could not abutt the spikes 502, and the only means for transmitting torque to the brush head 102 would be through the Velcro pads 116 which may come loose or slip. Accordingly, FIG. 6A illustrates the coupler 104 when in an extended position so as to position the riser's tabs 122 in contact with the centering device's 500 corresponding spikes 502 to facilitate transfer of torque. Also shown in this figure is a screw on locking member or locking plate 606 for clamping the brush head 102 onto the centering device 500 of the machine 600. The plate 606 may be threaded onto a threaded shaft 608 of the centering device 500. As shown, the threaded plate 606 may be locked in place via a pin 620.

With regard to FIGS. 6B-6C, the pad 610 utilized on the machine 600 defines a mounting surface which abuts the back surface 118 of the brush head 102 and is configured to mate with the attachment pads 116 of the brush head 102 (e.g., corresponding hook and loop fasteners), but this mounting surface of the pad 610 is not offset below the centering ring 500 as much as with the tufted pad 602 detailed with regard to FIG. 6A, above. In this example, the coupler 104 of the brush system 100 is in a collapsed position and the riser 106 is in engagement with the centering device 500. Due to the pad 610 having less of a height difference between the mounting surface of the pad 610 and its corresponding centering ring device, the riser's 106 tabs 122 are able to reach and interface with the spikes 502 on the centering device 500 when the coupler 104 is collapsed.

Figure 7A:
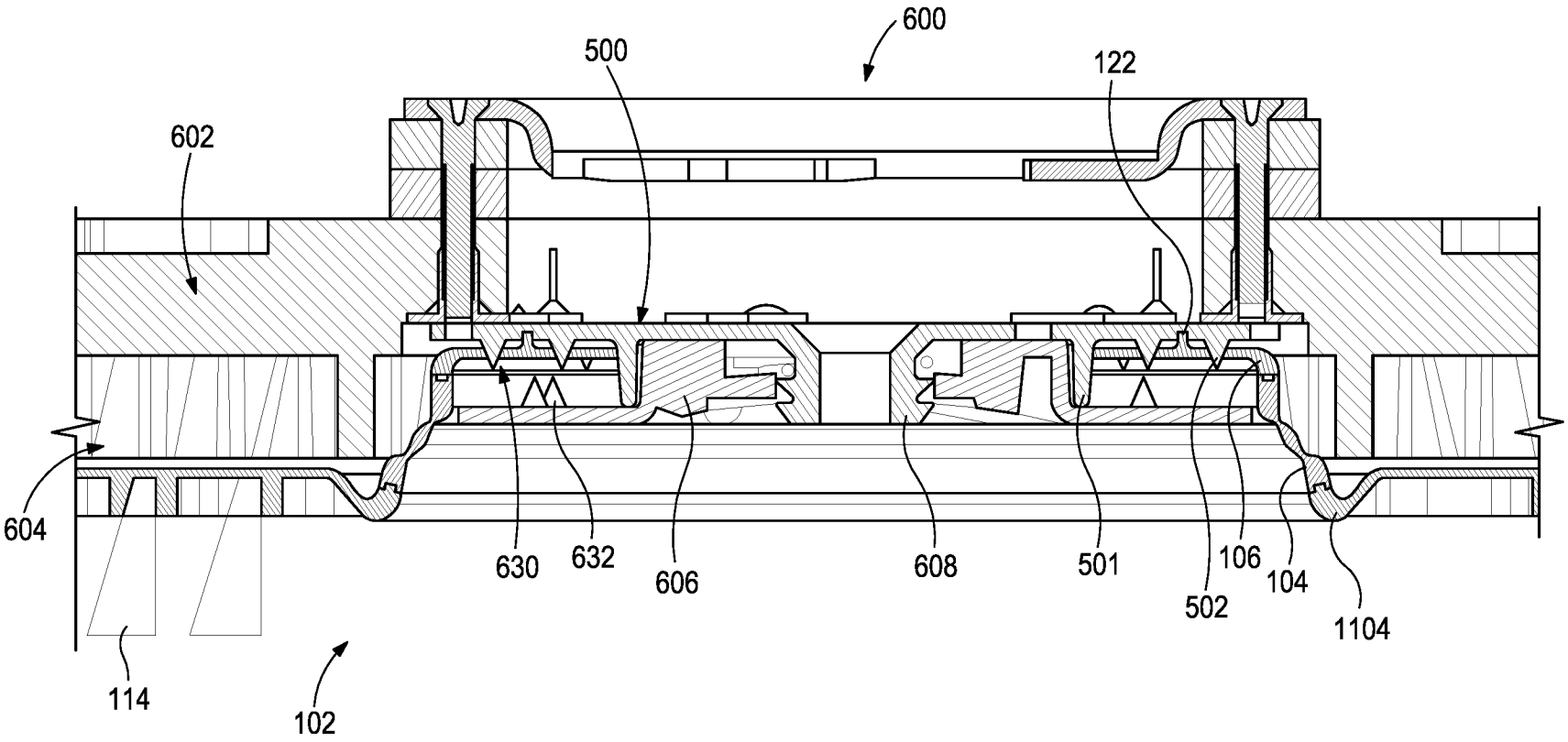
FIGS. 7A-7B another example operation of the coupling system of FIG. 1.
Figure 7B:
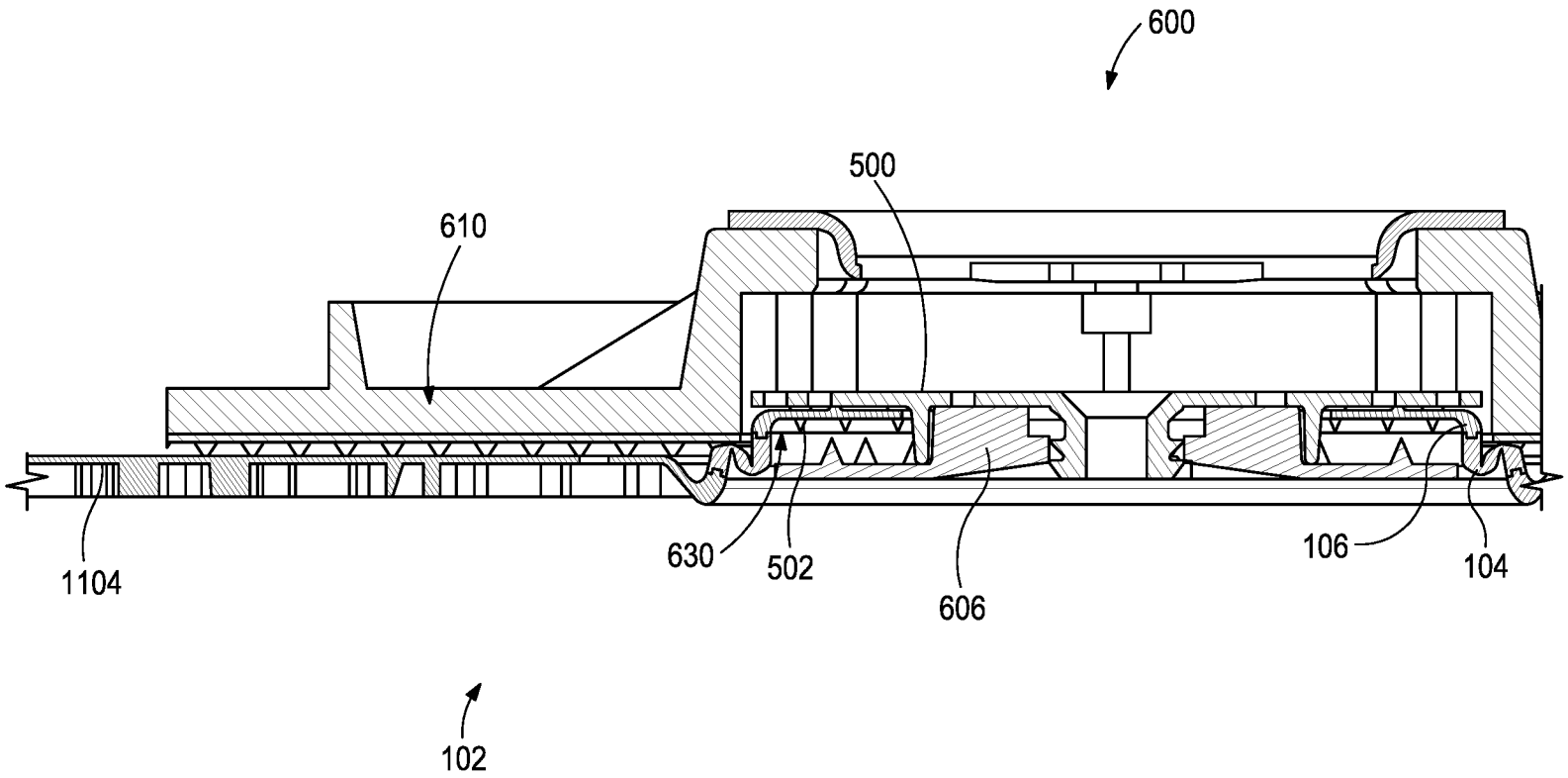

In particular, FIG. 7A and FIG. 7B illustrate alternate examples of the brush head 102 having alternate risers 106 utilized with the pads 602 and 610, respectively. In these examples, the riser 106 has a plurality of engagement holes 630 configured to mate or engage with spikes 502 on the center ring 500. In these examples, the riser 106 optionally includes the tabs/ribs 122 such that, during operation, each of the tabs engages one of the pairs of spikes. For example, a first tab 122*a* will engage the first set of spikes 502*a*, and so on, such that the brush system 100 does not slip when installed on the centering device. In particular, the centering device 500 is mounted on the floor machine 600 and the floor machines drives rotation of the centering device, and it is desirable that there is little to no rotational slippage between the brush head 102 and the centering device 500. Engagement of the tabs 122 and the spike pairs 502 eliminates such slippage and ensures the brush head 102 is rotated with adequate force. Also in this example, the holes 630 may be provided and positioned in the riser 106 for receiving corresponding spikes 632 of the locking member 606; though, in the illustrated examples, the spikes 632 of the locking member do not reach upward enough to engage the corresponding holes in the riser 106.

Thus, the brush system 100 is able to accommodate floor machines having different height configurations, due to the adjustability of the coupler 104 (i.e., its ability to expand and collapse). Rather than having to use a different brush on the first and second pads 602, 610, the presently disclosed brush system 100 is adjustable to be able to be used on machines with different height configurations.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The terms "proximal" and "distal" are defined herein relative to a floor cleaning machine utilizable by an operator, the machine having an interface configured to mechanically couple a brush head. The term "proximal" refers to the position of an element closer to the operator or interface and the term "distal" refers to the position of an element further away from the operator or interface. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A brush system for a floor machine, the brush system comprising:

a brush head, a flexible coupler attached to the brush head, and a riser attached to the flexible coupler, wherein the flexible coupler is expandable to vary a position of the riser relative to the brush head, wherein the flexible coupler is adjustable between a fully collapsed position and a fully extended position, wherein the brush head is relatively further from the riser when in the fully extended position as compared to the fully collapsed position; and wherein the flexible coupler includes a base portion that is attached to the brush head and an upper portion that is attached to the riser, and wherein the upper portion telescopes within the base portion when in the fully collapsed position.

2. The brush system of claim 1, wherein the brush head comprises:

a pad having a bristle surface and a floor machine mounting surface opposite the bristle surface;

a plurality of tuft sites protruding from the bristle surface and defining a weight reducing void between neighboring tuft sites; and a tuft of bristles arranged in at least one of the tuft sites.

3. The brush system of claim 2, wherein at least one of the tufts of bristles is flared.

4. The brush system of claim 2, wherein at least one cut-out is provided in the pad and extends between the bristle surface and the mounting surface.

5. The brush system of claim 4, wherein the cut-out is a centrally located cut-out that is coaxial with the pad.

6. The brush system of claim 4, wherein the cut-out is an intermediate cut-out provided at an intermediate region of the pad between a radial center and periphery of the pad.

7. The brush system of claim 6, wherein the intermediate cut-out includes a plurality of intermediate cut-out symmetrically provided about the pad.

8. The brush system of claim 2, wherein at least one zone without tuft sites is provided on the bristle surface.

9. The brush system of claim 2, wherein the plurality of tuft sites are arranged in concentrically extending rows corresponding with a periphery of the pad.

10. The brush system of claim 1, wherein the flexible coupler is adjustable into one or more intermediate positions between the fully collapsed position and the fully extended position.

11. The brush system of claim 1, wherein the brush head includes a central opening and the flexible coupler is connected to the brush head about the central opening.

12. The brush system of claim 11, wherein the brush head includes a lip extending around the central opening, the flexible coupler is attached to an upper surface of the lip.

13. The brush system of claim 1, wherein the riser comprises a top surface and a plurality of tabs on the top surface.

14. The brush system of claim 1, wherein the brush head is circular in shape.

15. The brush system of claim 1, wherein the base portion comprises a lower end attached to the brush head and an upper end attached to the upper portion of the flexible coupler, wherein a diameter of the flexible coupler varies along the base portion such that the diameter of the base portion decreases from the lower end towards the upper end.

* * * * *